United States Patent [19]

Watson et al.

[11] Patent Number: 4,787,630

[45] Date of Patent: Nov. 29, 1988

[54] EXERCISE DEVICE

[76] Inventors: Robert Watson, 2515 N. 61st Ter., Kansas City, Kans. 66104; Harold T. Pehr, 3920 W. 96th St., Overland Park, Kans. 66207

[21] Appl. No.: 38,321

[22] Filed: Apr. 14, 1987

[51] Int. Cl.[4] ..... A63B 23/04

[52] U.S. Cl. ..... 272/146; 272/97

[58] Field of Search ..... 272/146, 97, 114, 115, 272/33 R, 144, DIG. 4, 132, 134, 901, 142; 128/25 R, 253, 26

[56] References Cited

U.S. PATENT DOCUMENTS

| | | | |
|---|---|---|---|
| 2,573,808 | 11/1951 | Ravoire | 272/97 |
| 3,488,049 | 1/1970 | Susser, Jr. | 272/146 |
| 3,582,066 | 6/1971 | Keryluk | 272/97 |
| 3,612,519 | 10/1971 | Larson | 272/146 |
| 3,713,653 | 1/1973 | Romans . | |
| 3,806,116 | 4/1974 | Malmberg et al. | 272/146 |
| 3,834,693 | 9/1974 | Poppenberger | 272/97 |
| 3,911,907 | 10/1975 | Smith, Jr. . | |
| 3,929,329 | 12/1975 | Riueva | 272/146 X |
| 4,026,279 | 5/1977 | Simjian . | |
| 4,132,405 | 1/1979 | Asher | 272/146 |
| 4,143,521 | 1/1980 | Kroeker | 272/146 |
| 4,199,137 | 4/1980 | Giguere . | |
| 4,252,312 | 2/1981 | Dehan . | |
| 4,270,749 | 6/1981 | Hebern . | |
| 4,285,516 | 8/1981 | Heatwole . | |
| 4,290,601 | 9/1981 | Mittelstadt . | |
| 4,291,873 | 9/1981 | Lee et al. . | |
| 4,305,579 | 12/1981 | Rice . | |
| 4,376,532 | 3/1983 | Hunstad . | |
| 4,386,915 | 6/1983 | Gielian . | |
| 4,391,441 | 7/1983 | Simjian . | |
| 4,396,189 | 8/1983 | Jenkins | 272/97 |
| 4,505,477 | 3/1985 | Wilkinson | 272/146 |
| 4,509,743 | 4/1985 | Lie . | |

*Primary Examiner*—Richard J. Apley
*Assistant Examiner*—Howard Flaxman
*Attorney, Agent, or Firm*—Litman, McMahon & Brown

[57] ABSTRACT

An exercise device including rotatably interconnected base and platform assemblies. The base assembly is adapted to rock back and forth on a floor or other horizontal surface and a person using the device stands, sits, kneels or lays on the platform assembly. The device is adjustable whereby the permitted range of movement can be widely varied. Ropes, springs, elastic cords or poles can be grasped by a person using the device for balance and for upper body exercise.

18 Claims, 1 Drawing Sheet

EXERCISE DEVICE

BACKGROUND OF THE INVENTION

1. Field of the Invention.

The present invention relates generally to exercise equipment, and in particular to a device that a person can mount and rock, twist or both.

2. Description of the Prior Art.

The benefits of regular exercise are well known and include flexibility, strength, weight control, stamina and mental well-being. However, many people dislike some of the traditional forms of exercise such as calisthenics, weight training, running, etc. Running has been criticized because of the potential for physical harm to the feet, ankles and legs.

Participation in various sports and athletic endeavors is another popular form of exercise. Although such participation without additional physical training or exercise is possible, it is generally recognized that peak proficiency is attainable only by combining practice with a regular program of supplemental exercise. Participants in poor condition are more likely to injure themselves than well-conditioned athletes. Many sports, such as snow skiing, golf (in many parts of the country), water sports, etc., are seasonal and their particpants must exercise during the off-season to maintain peak physical condition for optimum performance during the regular season. Of course, these athletes often find the supplemental and off-season training and exercising much less satisfying than actual participation in their chosen sports. The present invention addresses these problems.

A variety of exercise devices have heretofore been proposed and some were designed to increase proficiency at particular sports. For example, balance plates and rolling boards have been used by snow skiiers to improve coordination and strengthen the muscle groups that are commonly used in downhill skiing, such as the leg and lower torso muscles. The Lie U.S. Pat. No. 4,509,743 discloses a balance training apparatus which is particularly adapted for use by downhill skiiers and includes a base-mounted foot plate. Irregular tilting movements in all directions are imparted to the foot plate disclosed therein.

The apparatus shown in the Dehan U.S. Pat. No. 4,252,312 is also designed for simulating skiing movements and includes a plate attached to a base by a connecting mechanism which permits rocking back and forth and rotation. The Hunstad U.S. Pat. No. 4,376,532 discloses another exercise device particularly designed for downhill skiiers and includes a pair of foot platforms rotatably and tiltably mounted on a base with wells for receiving the tips of a pair of ski poles. A training device for water skiiers is shown in the Gilliam U.S. Pat. No. 4,386,915 and comprises a platform rotatably mounted on a base. A ski rope is attached via a pulley to a weight to simulate the pull that would normally be exerted by the ski boat.

A disadvantage of many of the prior art exercise devices is that, being designed for a particular type of exercise which is often related to a particular sport, they are not well suited for general conditioning or conditioning for various other sports. For example, the training devices for downhill skiiers emphasize leg and ankle movement, with little corresponding benefit for the upper body. Another disadvantage with many previous exercise devices is that they included relatively little, if any, provision for adjusting the degree of permitted movement as is often desirable for users as they progresses in skill and ability. Furthermore, when the object is to rehabilitate injured muscle groups, it is highly desirable to provide for a wide range of movement which can become progressively less restricted as the patient's condition improves.

Heretofore, there has not been available an exercise device with the advantages and features of the present invention, and in particular its adaptability to various types of movement and its usefullness in training for a variety of sports.

SUMMARY OF THE INVENTION

In the practice of the present invention, an exercise device is provided which includes base and platform assemblies rotatably interconnected by a bearing assembly. The base assembly includes a removable rocker bar for rocking the entire device from side-to-side. Stop pins are insertable through the platform assembly to limit its rotational movement with respect to the base assembly. Ropes, springs or elastic cords with handles can be attached to the platform assembly for stability and for upper body exercise. Alternatively, a user can grasp a pair of poles to simulate, for example, downhill skiing. The exercise device is adjustable between a configuration of no movement and a configuration of simultaneous rocking movement and unlimited rotational movement.

OBJECTS OF THE INVENTION

The principal objects of the present invention are: to provide an exercise device which is adaptable for various types of exercises; to provide such a device which can be used for training for various sports; to provide such a device which is adapted for rocking back and forth; to provide such a device which includes a rotatable platform assembly; to provide such a device which can be used in pairs by one or two persons; to provide such a device which can be used in pairs for exercising with partners; to provide such a device which provides maximum safety protection by providing for a progressive series of exercises through various levels of difficulty; to provide such a device which is enjoyable to use partly because of the variety of different exercises that can be performed therewith; to provide such a device which improves strength, agility, stamina and coordination; to provide such a device which can be used by persons of all ages; to provide such a device which enhances the enjoyment and satisfaction derived from exercising; to provide such an exercise device which is designed and constructed to withstand relatively heavy usage; and to provide such a device which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
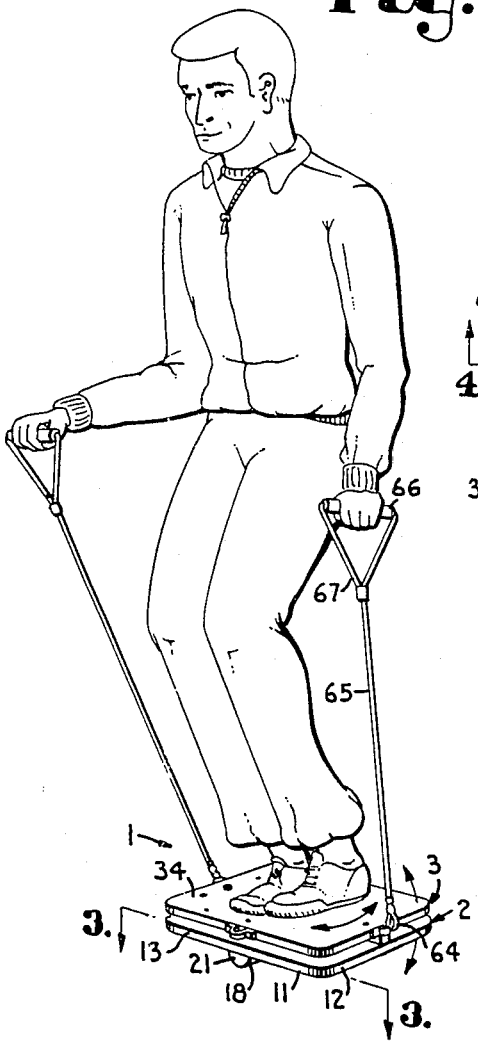
FIG. 1 is a perspective view of an exercise device embodying the present invention.
Figure 2:
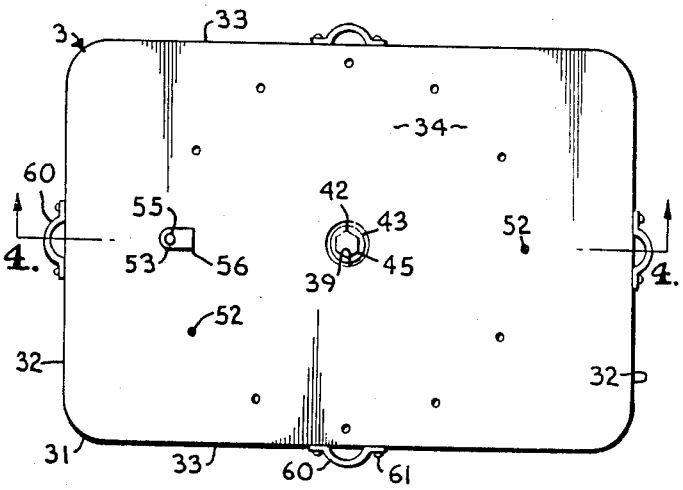
FIG. 2 is a top plan view of the exercise device.
Figure 3:
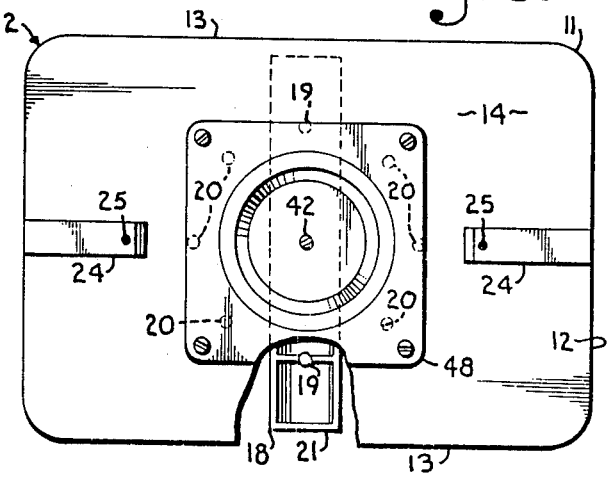
FIG. 3 is a horizontal cross-section of the device taken generally along line 3—3 in FIG. 1.
Figure 4:
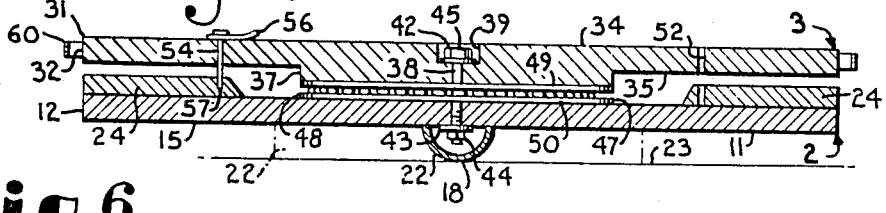
FIG. 4 is a longitudinal cross-section of the device taken generally along line 4—4 in FIG. 2.

For purposes of the description herein, the exercise device is oriented in FIG. 2 transversely from left to right and longitudinally from top to bottom.

Referring to the drawings in more detail, the reference numeral 1 generally designates an exercise device embodying the present invention and including base and platform assemblies 2, 3. The base assembly 2 includes a baseplate 11 with opposite sides 12, opposite ends 13, an upper surface 14 and a lower surface 15. A semi-cylindrical rocker bar 18 is mounted on the baseplate lower surface 15 by a pair of rocker pins 19 inserted in an opposed pair of pin receivers 20 which extend upwardly into the baseplate 11 from its lower surface 15. A total of eight rocker bar pin receivers 20 are provided in a circular pattern on the baseplate 11 and are spaced in a circular pattern at about 45° intervals whereby the rocker bar 18 can be oriented longitudinally, transversely or diagonally with respect to the baseplate 11. The orientation of the rocker bar 18 determines how the base assembly 2 will rock; e.g. side-to-side, end-to-end, or corner-to-corner. The rocker bar 18 includes a convex, semi-cylindrical contact surface 22 adapted to engage a floor 23 or other horizontal surface.

A pair of stop lugs 24 are mounted on the baseplate upper surface 14 and extend inwardly from respective ends 13 along a transverse centerline of the baseplate 11. Each stop lug 24 includes a respective upwardly-open stop pin receiver 25.

The platform assembly 3 includes a platform plate 31 with opposite sides 32, opposite ends 33, an upper surface 34 and a lower surface 35. The platform plate 31 includes a downwardly-projecting, thickened center portion 37. The base and platform plates 11, 31 include a pivot bolt receiver 38 extending vertically through the centers thereof along a rotational axis which extends in a direction substantially normal to said platform plate upper surface 34. The pivot bolt receiver 38 includes a countersunk portion 39 adjacent the platform plate upper surface 34 and receives a pivot bolt 42 extending through the pivot bolt receiver 38. The pivot bolt 42 receives washers 43 and threadably receives a nut 44 whereby the base and platform assemblies 2, 3 are retained together. The pivot bolt 42 includes a head 45 positioned in the receiver countersunk portion 39 over a washer 43.

The base and platform assemblies 2, 3 are rotatably interconnected by a bearing assembly 47 comprising a lower half 48 mounted in the center of the baseplate upper surface 14 and an upper half 49 mounted on the platform plate lower surface 35 under the center portion 37. A plurality of ball bearings 50 are positioned between the bearing assembly lower and upper halves 48, 49. Because the bearing assembly 47 is relatively wide, it cooperates with the pivot bolt 42 to support the platform plate 31 in spaced, parallel relation to the baseplate 11, even when the platform plate 31 is eccentrically loaded. The bearing assembly 41 also permits relatively free rotation between the base and platform assemblies 2, 3.

The platform plate 31 includes a plurality (8 are shown) of platform stop pin receivers 52 positioned in spaced relation around the platform plate rotational axis and extending between the platform plate upper and lower surfaces 34, 35. The stop pin receivers 52 are adapted to selectively receive one or two stop pins 53, each stop pin including a shank 54, a head 55 and a pull tab 56. The stop pin shanks 54 terminate at lower ends 57 in spaced relation above the baseplate upper surface 14.

At approximately the center of each of the platform plate sides 32 and ends 33, a respective loop 60 is mounted by respective fasteners 61. Each loop 60 receives a proximate end 64 of one of a pair of ropes 65, each of which also includes a handle 66 mounted on a distal end 67 thereof.

Figure 6:
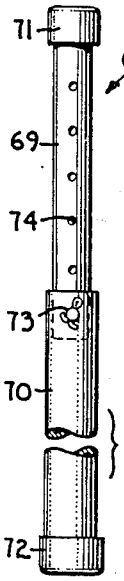
FIG. 6 is an elevation of an adjustable support pole designed for use with the device.
Figure 5:
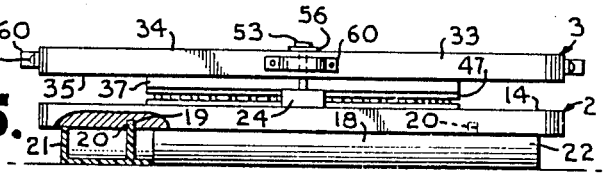
FIG. 5 is an end elevation of the device with portions broken away to reveal internal constructions.

As an alternative to the ropes 65, resilient members such as springs or elastic bungie cords (not shown) could be provided. Yet another alternative to the ropes 65 is shown in FIG. 6 and comprises a pair of telescoping poles 68 each including inner and outer telescoping sections 69, 70, upper and lower rubber tips 71, 72 and a mechanical fastener 73 adapted to extend through an aligned pair of inner section receivers 74 and an aligned pair of outer section receivers whereby the overall height of the pole 68 may be adjusted.

In operation, the exercise device 1 is adapted to be used for a variety of exercises and its movements can be adjusted over a relatively wide range to accommodate exercisers of various skill levels.

For example, the stop pins 53 can be placed in respective platform plate stop pin receivers 52 and the stop lug receivers 25 whereby rotation is prevented. The rocker bar 18 can be removed from the base assembly 2 and the baseplate lower surface 15 placed directly on the floor 23 with the exercise device 1 substantially immobilized. With the exercise device 1 thus immobilized, a beginning exerciser can stand on the platform plate 31 with his or her feet together and, using a pair of poles 68, swing his or her arms back and forth to gain familiarity with the exercise device 1. The stop pins 53 can then be moved to platform plate stop pin receivers 52 on either side of a respective stop lug 24 so that rotational movement through a relatively limited range is permitted. Thereafter, successively greater ranges of rotational movement can be obtained by selecting appropriate platform plate stop pin receivers 52. With the stop pins 53 in place, they are located above the platform plate upper surface 34 and engage the stop lugs 24 as the platform plate 31 rotates between predetermined stop positions. The stop pins 53 may be removed altogether to provide 360° rotational movement between the base and platform assemblies 2, 3. Using a single stop pin 53 provides a range of rotational movement between the stop lugs 24 of slightly less than 180°.

After the user gains confidence with the twisting motions of the device 1, the rocker bar 18 can be attached to the baseplate 11 to provide a side-to-side rocking motion. Preferably, the stop pins 53 are inserted through platform plate stop pin receivers 52 and into the stop lug stop pin receivers 25 to prevent rotation between the base and platform assemblies 2, 3 until the user is accustomed to the rocking motion. The range of rotational movement can then be steadily increased as described hereinbefore so that the relative rotation between the base and plate assemblies 2, 3 and the rocking motion cooperate to permit a wide range of movements. When a user becomes relatively adept at using the exercise device 1, the stop pins 53 can be removed and, with the rocker bar 18 in place, maximum freedom of movement is possible. In this configuration, a thorough workout of the entire body, and in particular the legs, can be accomplished. The lower joints such as the ankles, knees and hips, can be utilized to the utmost for maximum benefit.

The ropes 65 or a pair of poles such as that shown at 68 provide balance and provide a workout for the arms and the upper torso. With springs or bungie cords installed in place of the ropes 65, they could alternately be stretched and released in coordination with lower body movements to effect a more dynamic workout.

The exercise device 1 is adapted to train persons for participation in a wide variety of sports, including golf, basketball, baseball, bowling, boxing, walking, tennis, skiing (downhill, cross-country and water) and swimming. Many of these sports require particular agility in certain joints and strength in certain muscle groups. Accordingly, the exerciser can select the most appropriate configuration of the exercise device 1 to achieve the desired workout.

The twisting motion of the exercise device 1 is particularly well suited for exercising the stomach muscles, which is important in weight control and in practically all sports, since many athletic trainers feel that speed and power for various types of movements originate in the stomach or lower torso areas.

An exerciser can place one foot on each of a pair of exercise devices 1 to achieve differential movements with each leg, which can be important in training for sports such as downhill skiing wherein different conditions can be encountered by each of a pair of skiis. Persons who have been accustomed to such differential movements and react quickly to them may find that their downhill skiing abilities are accordingly enhanced.

Pairs of exercisers may also utilize a pair of the exercise devices 1. For example, each can grasp the respective handles 66 of the other's device 1 and thereby rotate their partner's platform assembly 3 while their own platform assembly 3 is rotated by their partner. Coordination and teamwork can make this a most enjoyable form of exercise for two or more persons.

Exercisers can also sit, lie prone and kneel on the platform plate 31 and engage in various rocking and twisting exercises. Exercising in time with music is also possible with the exercise device 1. In summary, the possibilities for various exercises with the exercise device 1 are virtually endless.

It is to be understood that while certain forms of the present invention have been illustrated and described herein, it is not to be limited to the specific forms or arrangement of parts described and shown.

What is claimed and desired to be secured by Letters Patent is as follows:

1. An exercise device, which comprises:

(a) a base assembly including a base plate with upper and lower surfaces;

(b) a platform assembly including a platform plate with upper and lower surfaces;

(c) a bearing connected to said base plate upper surface and said platform plate lower surface, said bearing being adapted to permit rotational movement about a rotational axis extending in a direction substantially normal to said base and platform plates and to maintain said base and platform plates in substantially parallel, spaced relation;

(d) stop means adapted for limiting the rotational movement of said platform assembly relative to said base assembly and comprising a stop lug mounted on said base plate upper surface and a stop pin projecting downwardly from said platform plate lower surface and adapted to engage said stop lug;

(e) said platform plate including a plurality of spaced stop pin receivers extending between its upper and lower surfaces and arranged in a circular pattern around said rotational axis; and (f) said stop pin comprising a shank adapted to be slidably and removably received in a respective stop pin receiver, a head and a pull tab received on said shank below said head and adapted to engage said platform plate upper surface.

2. The exercise device according to claim 1 which includes:

(a) a rocker bar mounted on the baseplate lower surface and projecting downwardly therefrom whereby said base assembly can be rocked, said rocker bar including a convex, semi-cylindrical contact surface.

3. The exercise device according to claim 2, which includes:

(a) said rocker bar having a pair of upwardly-projecting rocker bar pins; and (b) said baseplate having a plurality of opposed pairs of rocker bar pin receivers open at said baseplate lower surface and adapted to removably receive said rocker bar pins.

4. The exercise device according to claim 1, which includes:

(a) handle means; and (b) handle connector means connected to said handle means and said platform plate whereby said handle means is adapted to be positioned in spaced relation from said platform plate.

5. The exercise device according to claim 4 wherein:

(a) said handle connector means comprises a resilient, tensile member.

6. The exercise device according to claim 1, which includes:

(a) a pair of poles adapted to be grasped by a person using said exercise device for engagement with a floor surface on which said exercise device is placed.

7. The exercise device according to claim 6 wherein each pole includes:

(a) a hollow outer section with an aligned pair of receivers;

(b) an inner section telescopically received in said outer section and including a plurality of aligned pairs of fastener receivers;
(c) a pair of tips each mounted on a respective section; and
(d) a mechanical fastener extending through said outer section receivers and a pair of inner section receivers.

8. An exercise device, which comprises:
(a) a base assembly including:
(1) a baseplate with opposite sides, opposite ends and upper and lower surfaces;
(2) a rocker bar mounted on said baseplate lower surface and projecting downwardly therefrom whereby said base assembly can be rocked; and
(3) a stop lug mounted on and projecting upwardly from said baseplate upper surface;
(b) a platform assembly including:
(1) a platform plate with opposite sides, opposite ends and upper and lower surfaces; and
(2) a plurality of spaced stop pin receivers extending between said platform plate upper and lower surfaces;
(c) a bearing connected to said baseplate upper surface and said platform plate lower surface, said bearing being adapted to permit rotational movement about a rotational axis extending in a direction substantially normal to said base and platform plates and to maintain said base and platform plates in substantially parallel, spaced relation; and
(d) a stop pin removably received in a respective stop pin receiver and projecting downwardly from said platform plate lower surface, said stop pin being adapted to engage said stop lug.

9. The exercise device according to claim 8, which includes:
(a) a pair of said stop pins each having:
(1) a shank adapted to be slidably and removably received in a respective stop pin receiver;
(2) a head connected to said shank;
(3) a pull tab mounted on said shank and engaging said head, said pull tab being adapted to engage said platform plate upper surface; and
(4) a lower end projecting downwardly from said platform plate lower surface and positioned in spaced relation above said baseplate upper surface.

10. The exercise device according to claim 9, which includes:
(a) a pair of said stop lugs; and
(b) each said stop lug having a stop pin receiver adapted to receive a respective stop pin lower end.

11. The exercise device according to claim 8, which includes:
(a) handle means; and
(b) connector means connected to said handle means and to said platform assembly whereby said handle means is adapted to be positioned in spaced relation from said platform assembly.

12. The exercise device according to claim 11, which includes:
(a) a pair of side loops each mounted on a respective platform plate side;
(b) a pair of end loops each mounted on a respective platform plate end;
(c) a pair of said handle means; and
(d) a pair of said connector means each comprising a flexible member attached to a respective loop.

13. The exercise device according to claim 8, which includes:
(a) said rocker bar having a pair of upwardly-projecting rocker bar pins; and
(b) said baseplate having a plurality of opposed pairs of rocker bar pin receivers open at said baseplate lower surface and adapted to receive said rocker bar pins whereby said rocker bar can be positioned at a plurality of locations on said baseplate lower surface.

14. The exercise device according to claim 8 wherein:
(a) said platform plate includes a thickened center portion whereat a portion of said platform plate lower surface is positioned below the remainder of said platform plate lower surface; and
(b) said bearing is mounted on said platform plate center portion.

15. The exercise device according to claim 8, which includes:
(a) a pivot bolt receiver extending through said baseplate and said platform plate, said pivot bolt receiver having a countersunk portion open at said platform plate upper surface;
(b) a pivot bolt extending through said pivot bolt receiver and including a head;
(c) said countersunk portion receiving said bolt head; and
(d) a nut threadably mounted on said bolt below said baseplate lower surface.

16. The exercise device according to claim 8, which includes:
(a) a pair of poles each adapted to be grasped by a person using said exercise device and engage a floor surface on which said exercise device is placed.

17. The exercise device according to claim 16 wherein each said pole includes:
(a) a hollow, outer section with a pair of aligned fastener receivers;
(b) an inner section telescopically received in said outer section and including a plurality of aligned pairs of apertures;
(b) a fastener extending through said outer section receivers and a pair of inner section receivers; and
(c) a pair of elastomeric tips mounted on said inner and outer sections respectively.

18. An exercise device, which comprises:
(a) a base assembly including:
(1) a baseplate with opposite sides, opposite ends and upper and lower surfaces;
(2) a plurality of opposed pairs of rocker bar pin receivers in said baseplate and open at the lower surface thereof;
(3) a rocker bar including a convex, semicylindrical contact surface and a pair of upwardly-projecting rocker bar pins adapted for removable placement in said rocker bar pin receivers; and
(4) a pair of stop lugs each mounted on and projecting upwardly from said baseplate upper surface and including a respective upwardly-open stop pin receive, each said stop lug being mounted adjacent a respective baseplate side;
(b) a platform assembly including:
(1) a platform plate with opposite sides, opposite ends, upper and lower surfaces and a downwardly-projecting thickened center portion;
(2) a plurality of stop pin receivers extending through said platform plate between its upper and lower surfaces, said stop pin receivers being positioned in a substantially circular pattern in spaced relation around said rotational axis;

(3) a pair of side loops each mounted on a respective platform plate side; and (4) a pair of end loops each mounted on a respective platform plate end;

(c) a pivot bolt receiver extending through the centers of said baseplate and said platform plate in alignment with said rotational axis, said pivot bolt receiver including a countersunk portion open at said platform plate upper surface;

(d) a pivot fastener including a pivot bolt rotatably received in said pivot bolt receiver and having a head received in the pivot bolt receiver countersunk portion and a nut threadably received on the pivot bolt below the baseplate lower surface;

(e) a bearing assembly centered on said rotational axis and including a lower half mounted on said baseplate upper surface, an upper half mounted on said platform plate lower surface below said platform plate thickened center portion and a plurality of ball bearings received between said bearing assembly halves;

(f) a pair of stop pins each including a shank, a head, a pull tab mounted on said shank below said head and a lower end, each said stop pin being adapted to be received in a respective stop pin receiver with said lower end thereof positioned in spaced relation above said baseplate upper surface;

(g) a pair of ropes each including a proximate end connected to a respective loop and a distal end; and (h) a pair of poles, each including:

(1) an inner section with a plurality of fastener receivers;

(2) a hollow outer section telescopically receiving said inner section and including an aligned pair of fastener receivers;

(3) a pair of tips each mounted on a respective section; and (4) a mechanical fastener extending through said outer section receivers and an aligned pair of inner section receivers.

* * * * *